United States Patent [19]

Richter

[11] 4,093,506

[45] June 6, 1978

[54] METHOD AND APPARATUS FOR EFFECTING EVEN DISTRIBUTION AND MIXING OF HIGH CONSISTENCY PULP AND TREATMENT FLUID

[75] Inventor: Johan C. F. C. Richter, Nice, France

[73] Assignee: Kamyr Aktiebolag, Karlstad, Sweden

[21] Appl. No.: 665,576

[22] Filed: Mar. 10, 1976

[30] Foreign Application Priority Data

Mar. 14, 1975 Sweden ..... 7502870

[51] Int. Cl.[2] ..... D21C 7/14; D21C 9/12; D21C 9/14; D21C 3/24

[52] U.S. Cl. ..... 162/17; 162/57; 162/66; 162/67; 162/87; 162/88; 162/243; 366/165; 366/325

[58] Field of Search ..... 259/5, 6, 22–26, 259/41–46, 64; 162/57, 243, 66, 67, 241, 87, 88, 52, 246, 17, 19, 237; 68/181 R

[56] References Cited

U.S. PATENT DOCUMENTS

| | | | |
|---|---|---|---|
| 3,074,786 | 1/1963 | Duthie | 259/5 |
| 3,293,117 | 12/1966 | Pennington et al. | 162/243 |
| 3,301,027 | 1/1967 | Rich | 68/181 R |
| 3,630,828 | 12/1971 | Liebergott et al. | 162/88 |
| 3,725,193 | 4/1973 | Montigney et al. | 162/67 |
| 3,833,461 | 9/1974 | Woodruff | 162/241 |
| 3,966,542 | 6/1976 | Oldshue | 162/57 |

FOREIGN PATENT DOCUMENTS

| | | | |
|---|---|---|---|
| 1,593,422 | 3/1967 | France | 162/88 |
| 764,425 | 12/1956 | United Kingdom | 162/66 |

OTHER PUBLICATIONS

Rydholm, "Pulping Processes," Interscience Publishers, 1967, pp. 862–863.

*Primary Examiner*—S. Leon Bashore
*Assistant Examiner*—Steve Alvo
*Attorney, Agent, or Firm*—Cushman, Darby & Cushman

[57] ABSTRACT

Method and apparatus for the continuous distribution and mixing of high concentration pulp with at least one treatment fluid such as chlorine or chlorine dioxide. An enclosed housing has a cylindrical portion, a closed conical wall portion extending inwardly from one end of the cylindrical portion, and a generally converging open conical portion extending outwardly from the other end of the cylindrical portion. High concentration pulp is introduced into the cylindrical portion of the housing, and a rapid circular movement is imparted thereto by rapidly rotating rotor transport blades, so that the pulp is essentially fluidized. Treatment fluid is added to the pulp through the cylindrical housing portion to generally form a layer over pulp rotating in the cylindrical housing portion. The circular movement of the pulp and treatment fluid is transformed into a whirling translational movement thereof as the pulp moves from the cylindrical portion of the housing through the open conical portion of the housing, and eventually out an opening at the termination of the open conical portion of the housing, and the pulp and treatment fluid are totally mixed by the time they exit from the housing for passage to another treatment station.

10 Claims, 3 Drawing Figures

A
21
3

12
25
4
1
5
2
7
24
α
6
13
10
11
8
9
A 20
21

22
α
3
13
9

METHOD AND APPARATUS FOR EFFECTING EVEN DISTRIBUTION AND MIXING OF HIGH CONSISTENCY PULP AND TREATMENT FLUID

BACKGROUND AND SUMMARY OF THE INVENTION

The invention relates to a method and apparatus for distribution and mixing of high concentration or consistency (5% or higher) cellulose pulp with a treatment fluid, such as chlorine or chlorine dioxide.

The object of the invention is to make such distribution and mixing as effective as possible, so that the treatment fluid(s) is distributed as evenly as possible in the pulp suspension when introduced thereto, so that mixing of the pulp suspension and treatment fluid is effected, so that even a relatively small quantity of a treatment fluid is distributed evenly in and around all particles or fibers of the pulp suspension.

The effectiveness of such distribution and mixing depends on many factors, such as the pulp concentration in relation to the quantity of liquid or gas which is to be added, the solubility of the added liquid or gas in the suspension liquid, and to the reaction speed of the added treatment fluid with the particles of the pulp suspension. Generally, it can be said that the higher the concentration of solids or fibers in the pulp suspension, the more difficult it is to mix in treatment fluids so that they are evenly distributed in the suspension. Generally, it can also be said that the faster the added fluids react with the pulp, the more important it is that the fluids are distributed and mixed in as quickly and as evenly as possible. Since chlorine reacts quickly with pulp, and since it is desirable to treat high solids concentration pulp during bleaching, it is especially important to quickly mix chlorine with pulp. Since chlorine has an especially quick initial reaction with pulp and since it is undesirable to dilute the pulp with additional quantity of liquid, chlorine is most often added as gas dispersed in a relatively small quantity of liquid which, however, in turn means that problems can easily arise in the distribution and mixing of such a relatively small quantity. An object with the invention is therefore to solve this problem and also to solve the problems which arise when the pulp suspension has relatively high consistency of fibers, preferably above 5%, e.g., about 8–20% or about 10%.

In the pulp industry bleaching of pulp with chlorine liquid has hitherto preferably been done at 3–4% concentration mainly due to mechanical difficulties with mixing in and distribution [gas phase chlorination may be done with a pulp concentration in the range of 20–50%]. Since in other treatment stages of industrial bleach plants the pulp concentration normally is kept around 10%, it is desirable also to be able to effect the treatment of pulp with chlorine at this same concentration so that one can use uniform equipment in the bleach plant. This has special importance for the washing apparatus which is used between the treatment stages. Since the treatment with chlorine most often takes place in the beginning of the bleach plant and the pulp therefore must be thickened to about 10% concentration before the pulp goes on to the next treatment state, simplification and bulk reduction of equipment can be obtained if this first chlorine treatment also can take place at about the same high concentration.

The present invention allows chlorine treatment with proper mixing of high concentration pulp, as will become clear from an inspection of the detailed description of the invention and the appended claims.

DETAILED DESCRIPTION OF THE INVENTION

Figure 1:
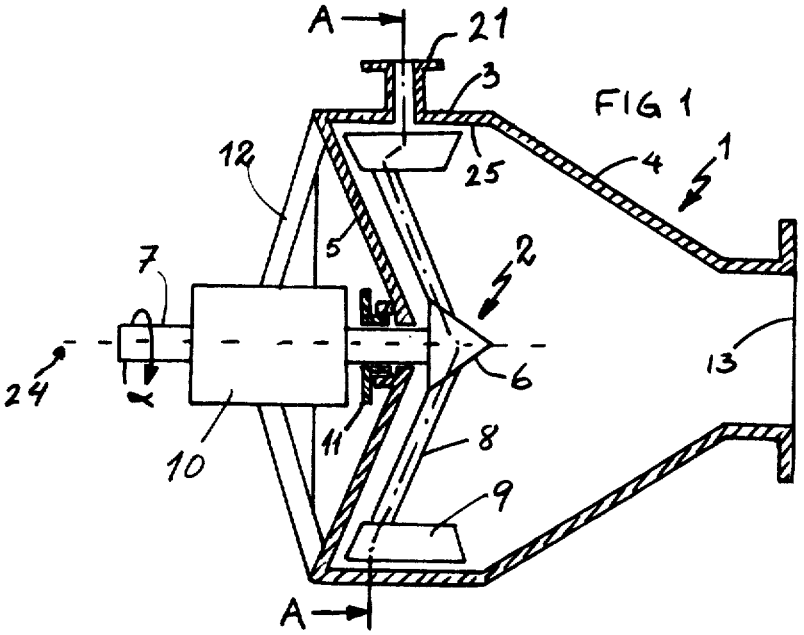
FIG. 1 is a schematic section view of exemplary distribution and mixing apparatus according to the present invention.

The device in FIG. 1 consists of a concentric housing 1, in which a rotor 2 can rotate by means of a motor (not shown). The housing 1 consists of a cylindrical portion 3, a generally converging open conical housing portion 4 extending outwardly from one end of the cylindrical portion 3, and a closed conical wall portion 5 extending inwardly from the other end of the portion 3. The rotor 2 consists of a hub 6, which is fastened to a shaft 7. A number of arms 8 connect hub 6 to transport blades or wings 9. The shaft 7 is supported in a bearing housing 10 and by means of a suitable mechanical sealing or packing box 11 is sealed from the outside environment. The bearing housing 10 is fastened to the housing by means of supporting bars 12.

Figure 2:
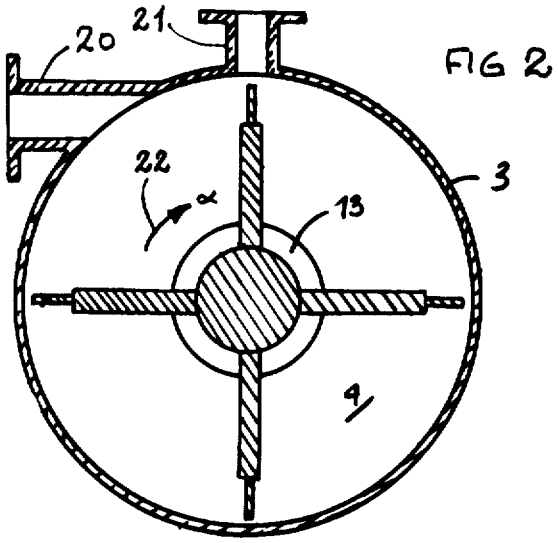
FIG. 2 is a schematic cross-sectional view taken along lines AA of FIG. 1 of the apparatus of FIG. 1.

A connection piece of pulp inlet 20 (see FIG. 2) through which pulp flows into the device, and a connection piece 21 or treatment fluid inlet are arranged in the cylindrical part 3 of the housing and can be arranged tangentially, as is shown for the connection 20 in FIG. 2. The rotor has a rotation direction $\alpha$ as shown by the arrow 22 so that pulp is introduced tangentially into housing portion 3 in the direction of rotation $\alpha$. After treatment in the device the pulp flows out through the opening or pulp outlet 13 at the termination of the open conical portion 4.

The device shown in FIG. 1 and FIG. 2 functions in the following manner: High (e.g., 10–12%) concentration pulp is added to the device in a continuous flow through the connection 20. The rotor 2, which rotates with a definite suitable speed of revolution about axis 24, imparts a rapid circular movement to the incoming pulp. The housing 1 is all the time filled with pulp, which eventually exits through the outlet 13. The rotor wings 9 are made so that the incoming pulp already at the entrance into the inner part of the device, adjacent inner wall 25 of housing portion 3, thrown against the inner wall 25 due to the centrifugal force, and thus circular movement of the pulp about axis 24 is initiated. A liquid treatment medium or, e.g., chlorine gas dispersed in relatively small quantity of liquid is added through the connection 21. This added liquid quantity which is added peripherially (i.e., radially) in the cylindrical part 3 will be distributed as a layer on top of the pulp recently added through inlet 20, which pulp rotates as a layer against the inner cylindrical wall 25. When the pulp layer with the added chemical layer has rotated around the inner part of the housing and returned back to the inlet 20, a new layer of pulp will be added onto the outside of the first one and a new layer of chemicals will be added onto the outside of the newest pulp layer. In this way repeated layers will be built up which layers are forced to move radially inwardly and eventually the circular movement thereof is transformed into a whirling movement translating along axis 24, and eventually to the outlet 13, the transformation of movement mode being due to the double conical shape of the housing. If it is desirable to distribute the chemicals or to add more chemicals, more connections 21 can be arranged after each along the circumference of the cylindrical part 3. The mixed pulp and treatment fluid is then transported to another treatment station. The mixed pulp and treatment fluid no longer has a whirling movement during transport to the other treatment station, essentially no whirling taking place after exit of the pulp from outlet 13.

During practice trials it has been shown that the pulp during the movement inside the housing from the cylindrical part 3 out through the conical part 4 towards the outlet 13 undergoes an intensive mixing which mainly is due to the contraction which is taking place in the conical converging area 4 at the same time as the friction against the housing inner walls slows down the rotation of the pulp, while the rotation in the central portion of the area 4 continues since an intensive whirl current with an inwardly increasing speed of revolution is built up in the central portion. Due to such conditions displacements between the pulp layers will take place and the desired complete mixing is effected.

Figure 3:
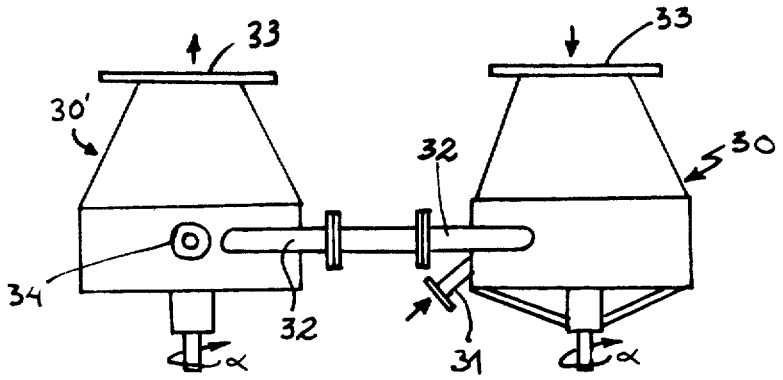
FIG. 3 is a schematic side view of two of the devices of FIG. 1 operably connected to each other.

In FIG. 3 two essentially identical devices 30, 30' are coupled together in a manner which has proved to be very advantageous during practice trials. The devices 30, 30' have been coupled together with inlet 32 of device 30 to inlet 32 of device 30', which means that the connections 32 and 33 of the first device 30 no longer function as an inlet and outlet, respectively, but rather since the pulp is added to the conical part 4 of the device 30 and exits through connection 32 which is coupled together with the normal tangential inlet 32 of the device 30'. It is obviously also possible to couple the devices 30, 30' in series in a more conventional manner in that the pulp is pumped into the tangential inlet 32 of the first device 30 and exits through outlet 33 of device 30, which outlet 33 is coupled to the tangential inlet 32 of the next device 30' in which the pulp exits through the outlet 33 thereof. Depending upon the number of chemical treatment desired, obviously more devices can be coupled together in the first or last mentioned manner. A treatment which has recently become very common is sequence-chlorination by which a chlorine containing medium, e.g., chlorine dioxide, of certain quantity is added to the pulp before the actual clorination. Such a procedure can in a very effective manner be used if two devices are coupled together as shown in FIG. 3. Then, for example, chlorine dioxide solution can be pumped into the inlet 31 on the cylindrical part of the first device 30. The solution can even be added earlier in the pulp stream, e.g., in the conical part 4 after the inlet. The chlorine solution, or chlorine gas dispersed in liquid is added to the second device 30' through the connection 34. Each shaft 7 of the devices 30, 30' rotates in the same direction of rotation $\alpha$—the same direction as the shaft 7 in FIG. 1.

A device according to the invention has proven to be very effective, which is surprising given the relatively small volume thereof. It is likely that the surprisingly good distribution and mixing results depend to a great extent upon imparting a relatively strong rotation to the pulp suspension, a linear peripherial velocity being imparted which is at, or close to the velocity at which the pulp suspension is fluidized and thereby leaves its viscoelastic state. This velocity varies with the type of pulp, suspension liquid, and most likely also with the content of gas bubbles in the pulp.

One application of the invention which is very practical is in connection with oxygen delignification of pulp, whereby one or more devices according to the invention can be used for mixing-in the necessary quantity of oxygen into the pulp. Since, however, oxygen has a very slow solubility in water, the pulp suspension can most suitably be added to a retention tower, reactor, after the distribution and mixing into the pulp. The method and apparatus of the invention can also be used effectively at super-atmospheric pressures such as those existing in $O_2$- delignification.

Another application of the invention can be in connection with addition of chemical solutions to pulp, when the chemicals are dissolved in great quantities of liquid due to low solubility and add to the pulp of high concentration, e.g., 40%, and afterwards distribute and mix during simultaneous dilution of the pulp to, for example, about 10%. Since such high concentration pulp normally is not possible to pump, a vertical inlet may be provided for the device into which the pulp can "fall". Otherwise, the device is independent of orientation (both horizontal or vertical arrangements being functional).

The invention can furthermore be discerned from the following practical example, in which two devices 30, 30' were coupled together such as shown in FIG. 3. During the trials the pulp was made up of normal birch sulphate pulp and the pulp quantity which was added to the devices was between 50 and 80 tons/24 hours. During the trials chlorine dioxide solution was added to the first device and dispersed chlorine gas in the other device corresponding to a total chlorine consumption of 3.6 weight % in relation to the pulp. The concentration of the pulp was between 8 and 12%, its normal concentration as it arrives from digesting and washing stations. The pulp was pumped to the devices by means of a high density pump and after chlorine treatment the pulp continued to the bottom of a 10 meter high bleach tower with built-in continuous wash devices of diffuser type. The rotors 2 of the devices 30, 30' were run at about 250 rpm which with the actual apparatus size, with inside largest diameter of 800 mm, corresponded to a peripheric velocity of about 10 m/sec in the cylindrical part. The power consumption was 8 KWH per ton pulp. The temperature of the pulp during the trials was between 40° and 60°C, which is an unusually high temperature for chlorination since it normally takes place at room temperature. The higher temperature is, however, a result of the system being closed, and of course influences the reaction speed of the chemicals with the pulp. This was confirmed through tests which showed that approximately all chlorine was consumed during the passage through the devices with a Kappa-number decrease from 18 to 4. Tests have shown that the pulp strength characteristics are extremely good and that the viscosity decrease lies within normal values.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method for continuously distributing and mixing high consistency pulp with at least one treatment fluid in a housing having a cylindrical portion comprising the steps of introducing pulp having a solids content of about 5% or more into the housing cylindrical portion, imparting a rapid circular movement about an axis of rotation to said pulp, corresponding to a linear peripheral velocity at the velocity at which the pulp is fluidized, after introduction into said housing cylindrical portion, said moving pulp being contained by said housing cylindrical protion, introducing treatment liquid in the housing cylindrical portion in a predominantly even layer over a layer of moving pulp in said housing cylindrical portion, thus forming repeated layers of pulp and treatment fluid, transforming the circular movement of said pulp having a layer of treatment fluid into a whirling movement translating along said axis of rotation of said pulp, so that displacement between the pulp layers takes place effecting complete mixing of said pulp and said treatment fluid, and transporting the now mixed pulp and treatment fluid to another treatment station, the mixed pulp and fluid no longer having a whirling movement during transport to the other treatment station.

2. A method as recited in claim 1 where said treatment fluid is a gaseous treatment fluid.

3. A method for continuously distributing and mixing high consistency pulp with at least one treatment fluid in a housing having a cylindrical portion comprising the steps of tangentially introducing pulp having a solids content of about 5% or more into the housing cylindrical portion, imparting a rapid circular movement about an axis of rotation to said pulp, corresponding to a linear peripheral velocity at the velocity at which the pulp is fluidized, after introduction into said housing cylindrical portion, said moving pulp being contained by said housing cylindrical portion, generally radially introducing treatment fluid in the housing cylindrical portion in a predominantly even layer over a layer of moving pulp in said housing cylindrical portion thus forming repeated layers of pulp and treatment fluid, transforming the circular movement of said pulp having a layer of treatment fluid into a whirling movement translating along said axis of rotation of said pulp so that displacement between the pulp layers takes place effecting complete mixing of said pump and said treatment fluid; said transforming being effected by providing a generally converging open conical portion extending outwardly from the housing cylindrical portion, and transporting the now mixed pulp and treatment fluid to another treatment station, the mixed pulp and fluid no longer having a whirling movement during transport to the other treatment station.

4. A method as recited in claim 3 wherein said treatment fluid introduced into said housing contains chlorine.

5. A method as recited in claim 4 wherein said treatment fluid is selected from the group consisting of chlorine, chlorine dioxide, and chlorine dioxide and chlorine.

6. A method as recited in claim 5 wherein said treatment fluid is chlorine and chlorine dioxide, and wherein one of chlorine and chlorine dioxide is added to said pulp in a second housing having a cylindrical portion before said pulp is introduced in the housing, and the other of chlorine and chlorine dioxide is added to said pulp in the housing.

7. A method as recited in claim 3, wherein said pulp has a concentration of about 8–12%.

8. Apparatus for continuously distributing and mixing high consistency pulp with at least one treatment fluid comprising an enclosed housing, said housing having a cylindrical portion thereof, means for tangentially introducing pulp having a solids consistency of about 5% or more into said housing cylindrical portion, means for imparting a rapid circular movement about an axis of rotation to said pulp, corresponding to a linear peripheral velocity at the velocity at which the pulp is fluidized, after introduction into said housing cylindrical portion, said moving pulp being initially contained by said housing cylindrical portion, means for generally radially introducing a treatment fluid into the housing cylindrical portion in a predominantly even layer over a layer of moving pulp in said housing cylindrical portion, thus forming repeated layers of pulp and treatment fluid, means for transforming the circular movement of said pulp having a layer of treatment fluid into a whirling movement translating along said axis of rotation of said pulp, so that displacement between the pulp layers takes place effecting complete mixing of said pulp and said treatment fluid, said transforming means comprising a generally converging open conical portion extending outwardly from one end of said cylindrical housing portion, said conical housing portion having an outlet disposed at the termination of the convergence thereof, and means for transporting the now mixed pulp and treatment fluid to another treatment station, the mixed pulp and fluid no longer having a whirling movement during transport to the other, treatment station.

9. Apparatus as recited in claim 8 wherein said means for imparting a rapid circular movement to said pulp includes a rotor having a plurality of transport blades attached thereto, each of said transport blades having a peripheral portion thereof spaced slightly from the inner wall of said housing cylindrical portion as said blades rotate in said housing, and means for imparting a rapid rotation to said rotor so that said pulp moves with a velocity at or near which the pulp is fluidized.

10. Apparatus as recited in claim 8 wherein said means for transforming the circular movement of said pulp into a whirling translating movement further includes a closed wall portion extending inwardly from the opposite end of said cylindrical housing portion of said generally converging conical portion.

* * * * *